US010304391B2

(12) United States Patent
Ge et al.

(10) Patent No.: US 10,304,391 B2
(45) Date of Patent: May 28, 2019

(54) ACTIVE MATRIX ORGANIC LIGHT-EMITTING DISPLAY AND CONTROLLING METHOD THEREOF

(71) Applicant: KUNSHAN GO-VISIONOX OPTO-ELECTRONICS CO., LTD., KunShan, Jiangsu (CN)

(72) Inventors: Mingwei Ge, KunShan (CN); Shingo Kawashima, KunShan (CN)

(73) Assignee: KUNSHAN GO-VISIONOX OPTO-ELECTRONICS CO., LTD., Jiangsu (CN)

( * ) Notice: Subject to any disclaimer, the term of this patent is extended or adjusted under 35 U.S.C. 154(b) by 57 days.

(21) Appl. No.: 15/537,865

(22) PCT Filed: Nov. 30, 2015

(86) PCT No.: PCT/CN2015/095918
§ 371 (c)(1),
(2) Date: Jun. 19, 2017

(87) PCT Pub. No.: WO2016/095697
PCT Pub. Date: Jun. 23, 2016

(65) Prior Publication Data

US 2018/0005587 A1 Jan. 4, 2018

(30) Foreign Application Priority Data

Dec. 17, 2014 (CN) ..... 2014 1 0788203

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0842* (2013.01);
(Continued)

(58) Field of Classification Search
CPC combination set(s) only.
See application file for complete search history.

(56) References Cited

U.S. PATENT DOCUMENTS 5,859,633 A 1/1999 Kim
2007/0146253 A1* 6/2007 Tang ..... G09G 3/3208 345/77

(Continued)

FOREIGN PATENT DOCUMENTS

CN 1934912 3/2007
CN 1934912 A 3/2007

(Continued)

*Primary Examiner* — Kenneth Bukowski
(74) *Attorney, Agent, or Firm* — Muncy, Geissler, Olds & Lowe, P.C.

(57) ABSTRACT

An active matrix organic light-emitting diode (AMOLED) display device and a controlling method thereof. The AMOLED display device (100) comprises a system power IC (110), a driver IC (120), an AMOLED panel (130), a power line (111) and a feedback line (112). The AMOLED panel (130) includes a plurality of pixel circuits. The system power IC (110) outputs a positive power supply voltage (ELVdd1) to the plurality of pixel circuits via the power line (111), and the driver IC (120) detects a positive power supply voltage (ELVdd2) actually applied to the plurality of pixel circuits via the feedback line (112) and compensates for data voltages (Vdata) based on the positive power supply voltage (ELVdd2) actually applied to plurality of pixel circuits. The driving chip detects the positive power supply voltage (ELVdd2) actually applied to plurality of pixel circuits, and automatically adjusts a minimum grayscale voltage (VREG1) and a maximum grayscale voltage (VGS) based on the positive power supply voltage (ELVdd2) actually applied to the plurality of pixel circuits, such that a certain difference value can be maintained between the data voltage (Vdata) and the positive power supply voltage (ELVdd2)

(Continued)

actually applied to the plurality of pixel circuits, thus eliminating Gamma offset.

6 Claims, 2 Drawing Sheets

(52) U.S. Cl.
CPC . *G09G 2310/027* (2013.01); *G09G 2320/029* (2013.01); *G09G 2320/0223* (2013.01); *G09G 2320/0233* (2013.01); *G09G 2320/0673* (2013.01)

(56) References Cited

U.S. PATENT DOCUMENTS

| | | | |
|---|---|---|---|
| 2011/0018787 | A1 | 1/2011 | Nakamura et al. |
| 2012/0044271 | A1 | 2/2012 | Lee et al. |
| 2013/0176349 | A1 | 7/2013 | Park et al. |
| 2013/0207569 | A1 | 8/2013 | Conti et al. |

FOREIGN PATENT DOCUMENTS

| | | | |
|---|---|---|---|
| CN | 101226712 | | 7/2008 |
| CN | 101226712 | A | 7/2008 |
| CN | 101290743 | A | 10/2008 |
| CN | 101295464 | A | 10/2008 |
| CN | 101893773 | A | 11/2010 |
| CN | 102142220 | A | 8/2011 |
| CN | 202601140 | | 12/2012 |
| CN | 202601140 | U | 12/2012 |
| CN | 103198779 | A | 7/2013 |
| CN | 103400547 | A | 11/2013 |
| CN | 103996374 | A | 8/2014 |
| CN | 104464627 | | 3/2015 |
| CN | 104464627 | A | 3/2015 |
| EP | 1583070 | A1 | 10/2005 |
| JP | 2006251602 | A | 9/2006 |
| KR | 2013-0081451 | A | 7/2013 |
| TW | 20072555 | A | 7/2007 |

* cited by examiner

ACTIVE MATRIX ORGANIC LIGHT-EMITTING DISPLAY AND CONTROLLING METHOD THEREOF

TECHNICAL FIELD

The present invention relates to the field of flat panel display devices and, in particular, to an active matrix organic light-emitting diode (AMOLED) display device and a method for controlling the AMOLED display device.

BACKGROUND

Unlike thin-film transistor liquid-crystal (TFT-LCD) display devices which need a backlight system for light emission, active matrix organic light-emitting diode (AMOLED) display devices emit light by themselves and are therefore more visible, brighter and thinner. Presently, AMOLED display devices are regarded as a new generation of display devices that will replace TFT-LCD display devices.

Each pixel element in an AMOLED display device includes a pixel circuit which serves mainly to provide an organic light-emitting diode (OLED) with a stable current. Reference is now made to FIG. 1 for the basic configuration of a pixel circuit in an AMOLED display device of the prior art. As shown in FIG. 1, the conventional pixel circuit 10 comprises: a thin film transistor (TFT), an OLED and a storage capacitor Cs. An output D of the TFT is coupled to an input of the OLED, and two terminals of the storage capacitor Cs are respectively coupled to the input and an output of the OLED. During operation of the pixel circuit 10, a pixel-side positive power supply voltage ELVdd and a pixel-side negative power supply voltage ELVss are input to a first input S of the TFT and the output of the OLED, respectively, concurrently with a data voltage Vdata being input to a second input G of the TFT. Based on the difference between the pixel-side positive power supply voltage ELVdd and the data voltage Vdata, the TFT produces a driving current which drives the OLED to emit light. The storage capacitor Cs acts to stabilize the current flowing through the OLED.

Thus, in the conventional pixel circuit, the brightness of the OLED and hence the light emission and grayscale performance of the corresponding pixel are controlled by the TFT serving as a voltage/current converter and the capacitor acting as a signal storage unit. As the brightness of the OLED is proportional to the current flowing therein, desirable light emission of it can be guaranteed if the current is maintained at a fixed level. The driving current, which determines the brightness of the OLED, is in turn determined by the difference between the pixel-side positive power supply voltage ELVdd and the data voltage Vdata.

However, in practical application, it has been found that OLEDs in AMOLED display devices fall short of their expected brightness levels due to gamma shifts, which is detrimental to display quality. In order to improve the AMOLED display quality, those skilled in this art have been looking for the causes and solutions for the occurrence of gamma shifts in them.

SUMMARY OF THE INVENTION

It is an object of the present invention to overcome the above described problems arising from the use of the existing AMOLED display devices, i.e., actual brightness levels lower than their expected values and the occurrence of gamma shifts, by presenting an AMOLED display device and a method for controlling it.

This object is attained by an AMOLED display device according to the present invention which includes: an AMOLED panel, including a plurality of pixel circuits; a system power IC, configured to output a positive power supply voltage to the plurality of pixel circuits via a power line; and a driver IC, configured to output data voltages to the plurality of pixel circuits, wherein the driver IC is also configured to detect a positive power supply voltage actually applied to the plurality of pixel circuits via a feedback line and compensate for the data voltages based on the detected positive power supply voltage.

Optionally, in the AMOLED display device, the driver IC may include: a minimum grayscale voltage adjustment module, configured to adjust and output a minimum grayscale voltage; a maximum grayscale voltage adjustment module, configured to adjust and output a maximum grayscale voltage; and a gamma circuit, connected to both the minimum grayscale voltage adjustment module and the maximum grayscale voltage adjustment module and configured to produce and output the data voltages based on the minimum grayscale voltage and the maximum grayscale voltage.

Optionally, in the AMOLED display device, the data voltage output by the gamma circuit may comprise voltage values respectively corresponding to grayscales of 0 through 255, wherein the minimum grayscale voltage is a one of the data voltages output by the gamma circuit that corresponds to a grayscale of 0, and wherein the maximum grayscale voltage is a one of the data voltages output by the gamma circuit that corresponds to a grayscale of 255.

Optionally, in the AMOLED display device, the driver IC may further include a detection pin, wherein one terminal of the detection pin is electrically connected to the plurality of pixel circuits, thereby enabling the detection of the positive power supply voltage actually applied to the plurality of pixel circuits, and wherein another terminal of the detection pin is electrically connected to the minimum grayscale voltage adjustment module and the maximum grayscale voltage adjustment module, thereby allowing the detected positive power supply voltage to be provided to the minimum grayscale voltage adjustment module and the maximum grayscale voltage adjustment module.

Optionally, in the AMOLED display device, the driver IC may further include a calculation module which is connected to each of the detection pin, the minimum grayscale voltage adjustment module and the maximum grayscale voltage adjustment module and configured to calculate a compensation for the minimum grayscale voltage and a compensation for the maximum grayscale voltage based on the positive power supply voltage detected by the detection pin and output the compensation for the minimum grayscale voltage and the compensation for the maximum grayscale voltage to the minimum grayscale voltage adjustment module and the maximum grayscale voltage adjustment module, respectively, wherein the minimum grayscale voltage adjustment module adjusts and outputs the minimum grayscale voltage based on the compensation for the minimum grayscale voltage, and wherein the maximum grayscale voltage adjustment module adjusts and outputs the maximum grayscale voltage based on the compensation for the maximum grayscale voltage.

Optionally, in the AMOLED display device, the minimum grayscale voltage adjustment module and the maximum grayscale voltage adjustment module may be provided with an input for setting of the compensation for the minimum grayscale voltage and an input for setting of the compensation for the maximum grayscale voltage, wherein the compensation for the minimum grayscale voltage and the compensation for the maximum grayscale voltage output by the calculation module are input to the minimum grayscale voltage adjustment module and the maximum grayscale voltage adjustment module through the input for setting of the compensation for the minimum grayscale voltage and the input for setting of the compensation for the maximum grayscale voltage, respectively.

Accordingly, the present invention also provides a method for controlling an AMOLED display device, comprising:

providing a plurality of pixel circuits with a positive power supply voltage by a system power IC;

detecting a positive power supply voltage actually applied to the plurality of pixel circuits by a driver IC;

determining whether a change resulting in the positive power supply voltage actually applied to the plurality of pixel circuits is an increase or decrease;

compensating for data voltages based on the change resulting in the positive power supply voltage; and outputting the data voltages that have been compensated for to the plurality of pixel circuits.

Optionally, in the method, the compensation for the data voltages produced by the driver IC based on the determined change resulting in the positive power supply voltage comprises:

setting a compensation for a minimum grayscale voltage and a compensation for a maximum grayscale voltage based on the positive power supply voltage actually applied to the pixel circuits;

adjusting the minimum grayscale voltage based on the compensation for the minimum grayscale voltage and the positive power supply voltage actually applied to the pixel circuits and adjusting the maximum grayscale voltage based on the compensation for the maximum grayscale voltage and the positive power supply voltage actually applied to the pixel circuits; and obtaining compensated data voltages based on an adjusted minimum grayscale voltage and an adjusted maximum grayscale voltage.

The inventors have recognized that differences between actual and expected brightness levels of the conventional AMOLED display devices are caused by power line impedances which reduce positive power supply voltages actually applied to their pixel circuits. The reductions lead to variations in the differences between the positive power supply voltages actually applied to the pixel circuits and data voltages Vdata and hence cause gamma shifts. In the AMOLED display device and the method for controlling it according to the present invention, through detection of the positive power supply voltage actually applied to the pixel circuits by the driver IC and automatic adjustment of the minimum grayscale voltage and the maximum grayscale voltage based on the positive power supply voltage actually applied to the pixel circuits, the differences between the data voltages and the positive power supply voltage actually applied to the pixel circuits can be maintained at constant values, thereby eliminating gamma shifts.

DETAILED DESCRIPTION

Active matrix organic light-emitting diode (AMOLED) display devices and methods for controlling them according to the present invention will be described below in detail with reference to specific embodiments and the accompanying drawings. The advantages and features of the invention will become more apparent from the following description and the appended claims. It is noted that the drawings are presented in a very simplified form not precisely drawn to scale with the only purpose of facilitating description of the embodiments of the invention.

Gamma shifts occur in existing OLEDs and cause them to fall short of their expected brightness levels, leading to unsatisfactory display quality of an AMOLED display device in which the OLEDs are used. The inventors have conducted extensive research and found that the failure of OLEDs in an existing AMOLED display device to provide expected bright levels is caused by impedances of power lines which, when currents flow in them to deliver a positive power supply voltage from a power integrated circuit (IC) of the display device to pixel circuits of pixels in the display device, cause drops in the positive power supply voltage, so that the pixel circuits are actually applied with a voltage that is lower than the intended positive power supply voltage. It is this voltage reduction that leads to brightness levels of the OLEDs that are lower than their respective target values according to a gamma curve for the AMOLED display device and hence degraded display quality of the display device.

Figure 1:
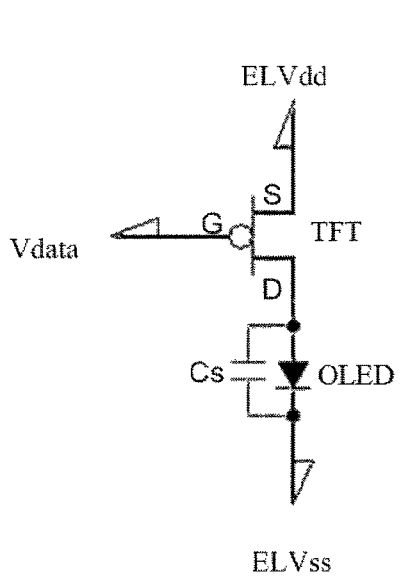
FIG. 1 schematically shows a pixel circuit in an AMOLED display device of the prior art.
Figure 2:
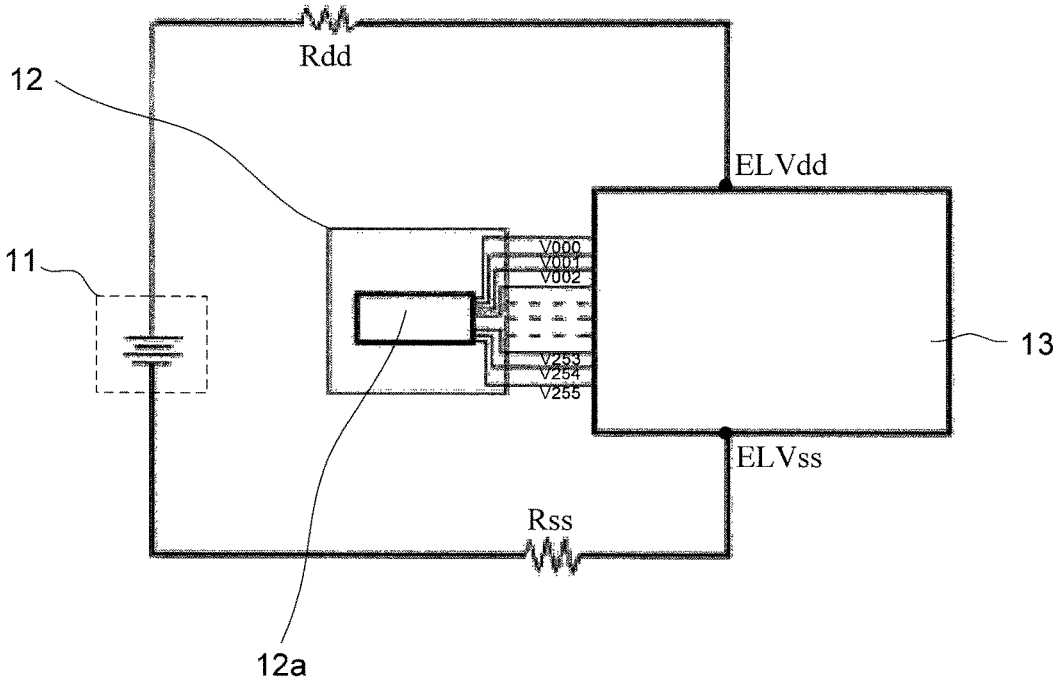
FIG. 2 is a diagram schematically illustrating a circuit of power lines in the AMOLED display device of the prior art.

Reference is now made to FIG. 2, which is a diagram schematically illustrating a circuit of power lines in an AMOLED display device of the prior art. As shown in FIG. 2, a power source 11 provided by a power IC of the display device is connected to an AMOLED panel 13 via power lines including a positive power line and a negative power line. Through the positive power line and the negative power line, the power source 11 applies a positive power supply voltage ELVdd and a negative power supply voltage ELVss to two terminals of the AMOLED panel 13. Assuming the positive power line has an impedance Rdd and the negative power line has an impedance Rss, a current I flowing in the AMOLED panel 13 will be reduced under the effect of these impedances. Accordingly, a voltage of the panel which changes in synchronization with the current will drop, affecting a positive power supply voltage ELVdd' actually applied to the pixel circuits.

The positive power supply voltage ELVdd' actually applied to the pixel circuits is given by the following equation:

$$ELVdd'=ELVdd-I\times(Rdd+Rss).$$

As indicated by this equation, the positive power supply voltage ELVdd' actually applied to the pixel circuits declines upon a rise in the current I in the AMOLED panel 13, and increases upon a decrease in the current I.

Data voltages Vdata are grayscale voltages output by a gamma circuit in a data driver IC. With continued reference to FIG. 2, the data driver IC 12 comprises a gamma circuit 12*a* which is configured to output grayscale voltages V000-V255, i.e., the data voltages Vdata. The data voltages Vdata are not affected by any change in the positive power supply voltage ELVdd' actually applied to the pixel circuits. Therefore, the differences between the positive power supply voltage ELVdd' actually applied to the pixel circuits and the data voltages Vdata change with the positive power supply voltage ELVdd' actually applied to the pixel circuits. The failure to maintain the differences between the positive power supply voltage ELVdd' actually applied to the pixel circuits and the data voltages Vdata leads to reductions in actual OLED brightness levels as well as gamma shifts.

In summary, as power line impedances affect the positive power supply voltage ELVdd' actually applied to the pixel circuits and thus lead to variations in the differences between the positive power supply voltage ELVdd' actually applied to the pixel circuits and the data voltages Vdata, the existing OLEDs fall short of their expected brightness levels and gamma shifts happen. In order to address this problem, the following solution is proposed in this application.

Figure 3:
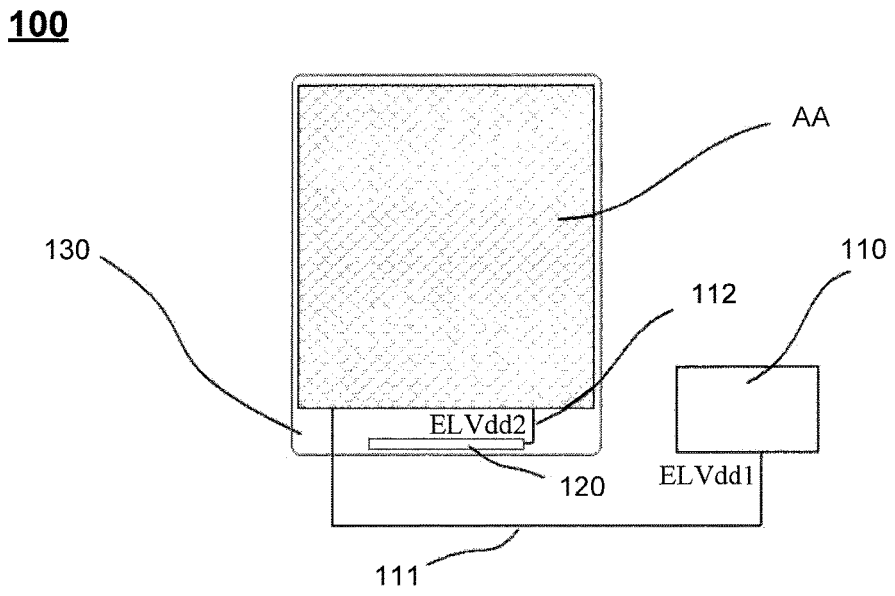
FIG. 3 is a schematic illustration of an AMOLED display device according to an embodiment of the present invention.

Reference is now made to FIG. 3, which is a schematic illustration of an AMOLED display device according to an embodiment of the present invention. As shown in FIG. 3, the AMOLED display device 100 comprises: a system power IC 110, a driver IC 120, an AMOLED panel 130, a power line 111 and a feedback line 112. The AMOLED panel 130 includes a plurality of pixel circuits (not shown), and the power IC 110 outputs a positive power supply voltage ELVdd1 to the pixel circuits via the power line 111. The driver IC 120 detects, via the feedback line 112, a positive power supply voltage ELVdd2 that is actually applied to the pixel circuits and compensates for data voltages Vdata based on the positive power supply voltage ELVdd2 actually applied to the pixel circuits.

Specifically, the AMOLED panel 130 has a display area AA in which the plurality of pixel circuits are disposed. Herein, the pixel circuits refer to circuits at respective pixel points in the AMOLED panel 130. Each of the pixel circuits serves mainly to provide an OLED with a stable current. In this embodiment, each pixel circuit comprises an OLED, a storage capacitor and a switch transistor. An output of the switch transistor is connected to an input of the OLED so that the OLED can be driven to emit light. The storage capacitor is connected in parallel to the OLED and is configured to stabilize a current flowing through the OLED. The switch transistor is implemented as a p-type thin film transistor.

It is noted that the structure of the pixel circuit is described above merely as an example and is not limited to this example.

The system power IC 110 is configured to provide the pixel circuits in the display area AA with positive and negative power sources. As shown in FIG. 3, the system power IC 110 is electrically connected to the pixel circuits in the display area AA by the power line 111, and outputs the positive power supply voltage ELVdd1 to the pixel circuits. As the power line 111 has an impedance R, the positive power supply voltage ELVdd2 actually applied to the pixel circuits is different in magnitude from the positive power supply voltage ELVdd1 provided by the system power IC 110.

For this reason, it is needed to measure the positive power supply voltage ELVdd2 actually applied to the pixel circuits. As shown in FIG. 3, the driver IC 120 is electrically connected to the pixel circuits in the display area AA via the feedback line 112, thereby allowing transmission of the positive power supply voltage ELVdd2 actually applied to the pixel circuits to the driver IC 120 via the feedback line 112. The driver IC 120 then compensates for the data voltages Vdata based on the positive power supply voltage ELVdd2 actually applied to the pixel circuits.

Figure 4:
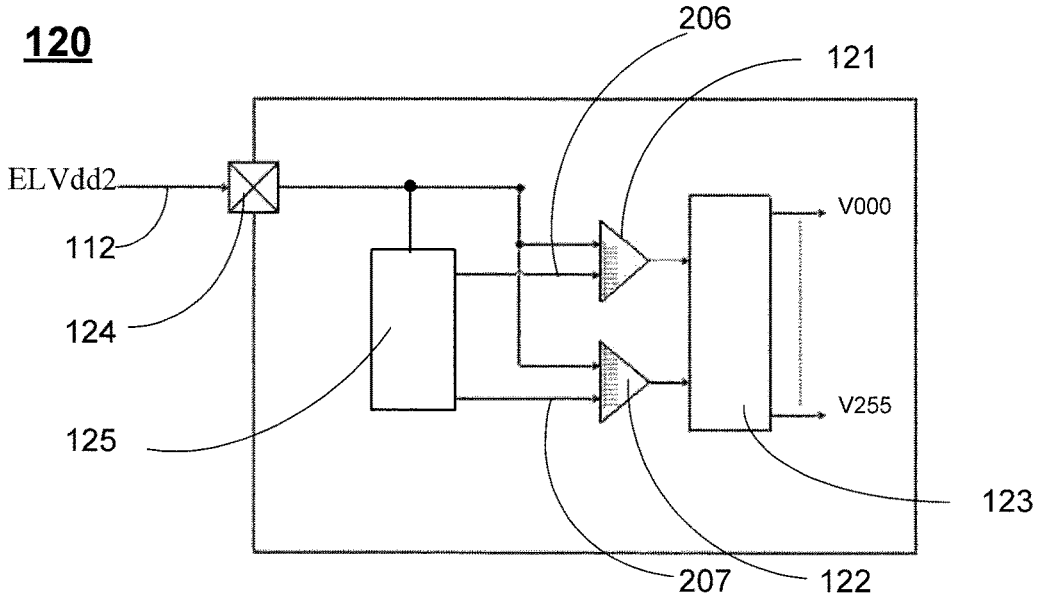
FIG. 4 diagrammatically shows how a driver IC works in accordance with an embodiment of the present invention.

Referring to FIG. 4, which diagrammatically illustrates how the driver IC works in accordance with the present invention. As shown in FIG. 4, the driver IC 120 comprises a minimum grayscale voltage adjustment module 121, a maximum grayscale voltage adjustment module 122 and a gamma circuit 123. An output of the minimum grayscale voltage adjustment module 121 and an output of the maximum grayscale voltage adjustment module 122 are both connected to an input of the gamma circuit 123. The gamma circuit 123 is configured to produce and output grayscale voltages V000 to V255, and the minimum grayscale voltage adjustment module 121 and the maximum grayscale voltage adjustment module 122 are configured to adjust a minimum grayscale voltage VREG1 and a maximum grayscale voltage VGS.

The minimum grayscale voltage VREG1 is the voltage V000 output by the gamma circuit 123 which corresponds to a grayscale of 0 (darkest), and the maximum grayscale voltage VGS is the voltage V255 output by the gamma circuit 123 which corresponds to a grayscale of 255 (brightest). The other grayscale voltages are all produced by a voltage division using resistors, with the minimum grayscale voltage VREG1 and the maximum grayscale voltage VGS serving as main references. In addition, the grayscale voltages V000 to V255 are also the data voltages Vdata output by the driver IC 120.

With continued reference to FIG. 4, the driver IC 120 further comprises a detection pin 124 having one terminal electrically connected to the pixel circuits and another terminal electrically connected to both the minimum grayscale voltage adjustment module and the maximum grayscale voltage adjustment module. Specifically, the detection pin 124 is connected to the pixel circuits via the feedback line 112, and passes the external voltage, i.e., the positive power supply voltage ELVdd2 actually applied to the pixel circuits, on to the minimum grayscale voltage adjustment module 121 and the maximum grayscale voltage adjustment module 122 in the driver IC 120.

With continued reference to FIG. 4, the driver IC 120 further comprises a calculation module 125 configured to calculate compensations for the minimum grayscale voltage VREG1 and the maximum grayscale voltage VGS. The minimum grayscale voltage adjustment module 121 and the maximum grayscale voltage adjustment module 122 are provided with an input 206 for setting of the compensation for the minimum grayscale voltage and an input 207 for setting of the compensation for the maximum grayscale voltage, respectively. The compensation for the minimum grayscale voltage VREG1 and the compensation for the maximum grayscale voltage VGS output by the calculation module 125 are input to the minimum grayscale voltage adjustment module 121 and maximum grayscale voltage adjustment module 122 through the inputs 206 and 207, respectively.

In the driver IC 120, an output of the minimum grayscale voltage adjustment module 121 varies in accordance with both the external voltage ELVdd2 and the compensation for the minimum grayscale voltage VREG1, while an output of the maximum grayscale voltage adjustment module 122 changes in accordance with both the external voltage ELVdd2 and the compensation for the maximum grayscale voltage VGS.

With continued reference to FIG. 4, an operation process of the driver IC 120 includes the following steps: at first, the external voltage, i.e., the positive power supply voltage ELVdd2 actually applied to the pixel circuits, is input to the driver IC 120 via the feedback line 112; the calculation module 125 in the driver IC 120 then performs a calculation based on the positive power supply voltage ELVdd2 actually applied to the pixel circuits to obtain the compensations for the minimum grayscale voltage VREG1 and the maximum grayscale voltage VGS, and inputs the compensations for the minimum grayscale voltage VREG1 and the maximum grayscale voltage VGS to the minimum grayscale voltage adjustment module 121 and the maximum grayscale voltage adjustment module 122, respectively; after that, the minimum grayscale voltage adjustment module 121 produces an output based on the compensation for the minimum grayscale voltage VREG1 and the positive power supply voltage ELVdd2 actually applied to the pixel circuits, and the maximum grayscale voltage adjustment module 122 produces an output based on the compensation for the maximum grayscale voltage VGS and the positive power supply voltage ELVdd2 actually applied to the pixel circuits; and the gamma circuit 123 subsequently generates adjusted grayscale voltages V000 to V255, i.e., the data voltages Vdata, based on the outputs of the minimum grayscale voltage adjustment module 121 and the maximum grayscale voltage adjustment module 122.

According to this embodiment, the driver IC 120 can not only provide the pixel circuits with the data voltages Vdata, but also detect the positive power supply voltage ELVdd2 actually applied to the pixel circuits and automatically adjust the data voltages Vdata based on the positive power supply voltage ELVdd2 actually applied to the pixel circuits. Upon an increase or decrease in the positive power supply voltage ELVdd2 actually applied to the pixel circuits, in order to maintain the differences between the positive power supply voltage ELVdd2 actually applied to the pixel circuits and the data voltages Vdata at constant values, the minimum grayscale voltage adjustment module 121 and the maximum grayscale voltage adjustment module 122 in the driver IC 120 can automatically raise or reduce the minimum grayscale voltage and the maximum grayscale voltage based on the compensations, thereby eliminating gamma shifts.

The driver IC 120 can be directly fixed on glass using a Chip On Glass (COG) technique. Alternatively, the driver IC 120 may also be fixed on a flexible circuit board using a Chip On FPC (COF) technique and is thereby connected to the AMOLED panel 130.

Accordingly, this embodiment also provides a method for controlling an AMOLED display device. Referring back to FIG. 3, the method includes the steps of:

step S10, providing the pixel circuits with the positive power supply voltage ELVdd1 by the system power IC 110;

step S11, detecting the positive power supply voltage ELVdd2 actually applied to the pixel circuits by the driver IC 120;

step S12, determining whether a change resulting in the positive power supply voltage ELVdd2 actually applied to the pixel circuits is an increase or decrease;

step S13, compensating for the data voltages Vdata based on the change resulting in the positive power supply voltage ELVdd2 actually applied to the pixel circuits; and step S14, outputting the data voltages Vdata that have been compensated for to the pixel circuits.

Specially, at first, the system power IC 110 provides the pixel circuits with the positive power supply voltage ELVdd1.

Next, the driver IC 120 detects the positive power supply voltage ELVdd2 actually applied to the pixel circuits.

Subsequently, it is determined whether a change resulting in the positive power supply voltage ELVdd2 actually applied to the pixel circuits is an increase or decrease.

Afterward, the data voltages Vdata are compensated for based on the positive power supply voltage ELVdd2 actually applied to the pixel circuits.

The compensation for the data voltages Vdata based on the positive power supply voltage ELVdd2 actually applied to the pixel circuits may specifically include: setting compensations respectively for the minimum grayscale voltage VREG1 and the maximum grayscale voltage VGS based on the positive power supply voltage ELVdd2 actually applied to the pixel circuits; adjusting the minimum grayscale voltage based on the compensation for the minimum grayscale voltage VREG1 and the positive power supply voltage ELVdd2 actually applied to the pixel circuits; adjusting the maximum grayscale voltage based on the compensation for the maximum grayscale voltage VGS and the positive power supply voltage ELVdd2 actually applied to the pixel circuits; and adjusting the data voltages Vdata based on the minimum grayscale voltage and the maximum grayscale voltage and thereby obtaining the data voltages Vdata that have been compensated for.

Lastly, the data voltages Vdata that have been compensated for are output to the pixel circuits.

In conclusion, in the AMOLED display device and method for controlling it according to the present invention, the driver IC detects the positive power supply voltage actually applied to the pixel circuits, based on which the minimum grayscale voltage and the maximum grayscale voltage are automatically adjusted. The data voltages are then compensated for such that the differences between the data voltages and the positive power supply voltage actually applied to the pixel circuits are maintained at constant values, resulting in the elimination of gamma shifts.

The foregoing description presents merely preferred embodiments of the present invention and does not limit the scope of the invention. All changes and modifications made in light of the foregoing disclosure by those of ordinary skill in the art fall within the scope of the appended claims.

What is claimed is:

1. An active matrix organic light-emitting diode display device, comprising:

an active matrix organic light-emitting diode panel, comprising a plurality of pixel circuits;

a system power IC, configured to output a positive power supply voltage to the plurality of pixel circuits via a power line; and a driver IC, configured to output data voltages to the plurality of pixel circuits, wherein the driver IC is further configured to detect a positive power supply voltage actually applied to the plurality of pixel circuits via a feedback line and compensate for the data voltages based on the detected positive power supply voltage, wherein the driver IC comprises:

a minimum grayscale voltage adjustment module, configured to adjust and output a minimum grayscale voltage;

a maximum grayscale voltage adjustment module, configured to adjust and output a maximum grayscale voltage;

a gamma circuit, connected to both the minimum grayscale voltage adjustment module and the maximum grayscale voltage adjustment module and configured to produce and output the data voltages based on the minimum grayscale voltage and the maximum grayscale voltage; and a detection pin, wherein one terminal of the detection pin is electrically connected to the plurality of pixel circuits for detecting the positive power supply voltage actually applied to the plurality of pixel circuits, and wherein another terminal of the detection pin is electrically connected to the minimum grayscale voltage adjustment module and the maximum grayscale voltage adjustment module for providing the detected positive power supply voltage to the minimum grayscale voltage adjustment module and the maximum grayscale voltage adjustment module.

2. The active matrix organic light-emitting diode display device of claim 1, wherein the data voltages output by the gamma circuit comprise voltage values respectively corresponding to grayscales of 0 through 255, wherein the minimum grayscale voltage is one of the data voltages output by the gamma circuit that corresponds to a grayscale of 0, and wherein the maximum grayscale voltage is one of the data voltages output by the gamma circuit that corresponds to a grayscale of 255.

3. The active matrix organic light-emitting diode display device of claim 1, wherein the driver IC further comprises a calculation module which is connected to each of the detection pin, the minimum grayscale voltage adjustment module and the maximum grayscale voltage adjustment module and configured to calculate a compensation for the minimum grayscale voltage and a compensation for the maximum grayscale voltage based on the detected positive power supply voltage provided by the detection pin and output the compensation for the minimum grayscale voltage and the compensation for the maximum grayscale voltage to the minimum grayscale voltage adjustment module and the maximum grayscale voltage adjustment module, respectively, wherein the minimum grayscale voltage adjustment module adjusts and outputs the minimum grayscale voltage based on the compensation for the minimum grayscale voltage, and wherein the maximum grayscale voltage adjustment module adjusts and outputs the maximum grayscale voltage based on the compensation for the maximum grayscale voltage.

4. The active matrix organic light-emitting diode display device of claim 3, wherein the minimum grayscale voltage adjustment module and the maximum grayscale voltage adjustment module are provided with an input for setting of the compensation for the minimum grayscale voltage and an input for setting of the compensation for the maximum grayscale voltage, respectively, and wherein the compensation for the minimum grayscale voltage and the compensation for the maximum grayscale voltage output by the calculation module are input to the minimum grayscale voltage adjustment module and the maximum grayscale voltage adjustment module through the input for setting of the compensation for the minimum grayscale voltage and the input for setting of the compensation for the maximum grayscale voltage, respectively.

5. A method for controlling an active matrix organic light-emitting diode display device, comprising:

providing a plurality of pixel circuits with a positive power supply voltage by a system power IC;

detecting a positive power supply voltage actually applied to the plurality of pixel circuits by a driver IC through a detection pin, wherein one terminal of the detection pin is electrically connected to the plurality of pixel circuits for detecting the positive power supply voltage actually applied to the plurality of pixel circuits, wherein another terminal of the detection pin is electrically connected to a minimum grayscale voltage adjustment module and a maximum grayscale voltage adjustment module for providing the detected positive power supply voltage to the minimum grayscale voltage adjustment module and the maximum grayscale voltage adjustment module, and wherein data voltages are produced based on a minimum grayscale voltage output from the minimum grayscale voltage adjustment module and a maximum grayscale voltage output from the maximum grayscale voltage adjustment module;

determining whether a change resulting in the positive power supply voltage actually applied to the plurality of pixel circuits is an increase or a decrease;

compensating for the data voltages based on the change; and outputting the data voltages that have been compensated for to the plurality of pixel circuits.

6. The method for controlling an active matrix organic light-emitting diode display device of claim 5, wherein compensating for the data voltages based on the change comprises:

setting a compensation for the minimum grayscale voltage and a compensation for the maximum grayscale voltage based on the positive power supply voltage actually applied to the pixel circuits;

adjusting the minimum grayscale voltage based on the compensation for the minimum grayscale voltage and the positive power supply voltage actually applied to the pixel circuits and adjusting the maximum grayscale voltage based on the compensation for the maximum grayscale voltage and the positive power supply voltage actually applied to the pixel circuits; and obtaining compensated data voltages based on the adjusted minimum grayscale voltage and the adjusted maximum grayscale voltage.

* * * * *